United States Patent [19]

Amidon et al.

[11] 4,197,211

[45] Apr. 8, 1980

[54] LIQUID ELECTROPHOTOGRAPHIC DEVELOPERS

[75] Inventors: Alan B. Amidon; Joseph Mammino; Robert M. Ferguson, all of Penfield, N.Y.

[73] Assignee: Xerox Corporation, Stamford, Conn.

[21] Appl. No.: 510,878

[22] Filed: Oct. 1, 1974

Related U.S. Application Data

[60] Continuation of Ser. No. 315,391, Dec. 15, 1972, abandoned, which is a division of Ser. No. 99,646, Dec. 18, 1970, Pat. No. 3,907,695, which is a continuation-in-part of Ser. No. 839,801, Jul. 1, 1969, abandoned.

[51] Int. Cl.[2] ..... G03G 9/00

[52] U.S. Cl. ..... 430/115

[58] Field of Search ..... 252/62.1

[56] References Cited

U.S. PATENT DOCUMENTS 3,776,849 12/1973 Tellier ..... 252/69.1

*Primary Examiner*—Jack P. Brammer

[57] ABSTRACT

Development of an electrostatic latent image is obtained with a chemically stable, nonaqueous, ambipolar, liquid developer comprising an oleaginous vehicle, solid colorant particles, a dispersant soluble in the liquid developer which is capable of substantially supressing background deposits, and a fixing agent miscible with the liquid which penetrates the copy paper.

11 Claims, No Drawings

LIQUID ELECTROPHOTOGRAPHIC DEVELOPERS

BACKGROUND OF THE INVENTION

This application is a continuation of application Ser. No. 315,391 filed Dec. 15, 1972, now abandoned which was a division of application Ser. No. 99,646 filed Dec. 18, 1970 now U.S. Pat. No. 3,907,695 which was a continuation-in-part of application Ser. No. 839,801 filed July 1, 1969 now abandoned.

This invention relates to imaging systems, and more particularly, to improved developer materials and development techniques.

The formation and development of images on the surface of photoconductive materials by electrostatic means is well known. The basic electrostatographic process, as taught by C. F. Carlson in U.S. Pat. No. 2,297,691 involves placing a uniform electrostatic charge on a photoconductive insulating layer, exposing the layer to a light and shadow image to dissipate the charge on the areas of the layer exposed to the light and developing the resulting electrostatic latent image by depositing on the image a finely divided electroscopic material referred to in the art as "toner." The toner will normally be attracted to those areas of the layer which retain a charge, thereby forming a toner image corresponding to the electrostatic latent image. This powder image may then be transferred to a support surface such as paper. The transferred image may subsequently be permanently affixed to a support surface as by heat. Instead of latent image formation by uniformly charging the photoconductive layer and then exposing the layer to a light and shadow image, one may form the latent image directly by charging the layer in image configuration. The powder image may be fixed to the photoconductive layer if elimination of the powder image transfer step is desired. Other suitable fixing means such as solvent or overcoating treatment may be substituted.

Similar methods are known for applying the electroscopic particles to the electrostatic latent image to be developed. Included within this group are the "cascade" development technique disclosed by E. N. Wise in U.S. Pat. No. 2,618,552; the "powder cloud" technique disclosed by C. F. Carlson in U.S. Pat. No. 2,221,776 and the "magnetic brush" process disclosed, for example, in U.S. Pat. No. 2,874,063.

Development of an electrostatic latent image may also be achieved with liquid rather than dry developer materials. In conventional liquid development, more commonly referred to as electrophoretic development, an insulating liquid vehicle having finely divided solid material dispersed therein contacts the imaging surface in both charged and uncharged areas. Under the influence of the electric field associated with the charged image pattern, the suspended particles migrate toward the charged portions of the imaging surface separating out of the insulating liquid. This electrophoretic migration of charged particles results in the deposition of the charged particles on the imaging surface in image configuration. Electrophoretic development of an electrostatic latent image may, for example, be obtained by flowing the liquid developer over the image bearing surface, by immersing the imaging surface in a pool of the developer or by presenting the liquid developer on a smooth surfaced roller and moving the roller against the imaging surface.

A further technique for developing electrostatic latent images is the liquid devlopment process disclosed by R. W. Gundlach in U.S. Pat. No. 3,084,043, hereinafter referred to as polar liquid development. In this method, an electrostatic latent image is developed or made visible by presenting to the imaging surface a liquid developer on the surface of a developer dispensing member having a plurality of raised portions or "lands" defining a substantially regular patterned surface and a plurality of portions depressed below the raised portions or "valleys". The depressed portions of the developer dispensing member contain a layer of conductive liquid developer which is maintained out of contact with the electrostatographic imaging surface. Development is achieved by moving the developer dispensing member loaded with liquid developer in the depressed portions into developing configuration with the imaging surface. The liquid developer is believed to be attracted from the depressed portions of the applicator surface in the charged or image areas only. The developer liquid may be pigmented or dyed. The development system disclosed in U.S. Pat. No. 3,084,043, differs from electrophoretic development systems where substantial contact between the liquid devloper and both the charged and uncharged areas of an electrostatic latent imaging surface occurs. Unlike electrophoretic development systems, substantial contact between the polar liquid and the areas of the electrostatic latent image bearing surface not to be developed is prevented in the polar liquid development technique. Reduced contact between a liquid developer and the nonimage areas of the surface to be developed is desirable because the formation of background deposits is thereby inhibited. Another characteristic which distinguishes the polar liquid development technique from electrophoretic development is the fact that the liquid phase of a polar developer actually takes part in the development of a surface. The liquid phase in electrophoretic developers functions only as a carrier medium for developer particles.

While capable of producing satisfactory images, these liquid development systems can be improved upon in certain areas. Troublesome difficulties are, for example, encountered in liquid development systems employing a reusable or cycling electrostatographic imaging surface. In these systems, for example, an imaging surface such as a selenium or selenium alloy drum type photoconductor is charged, exposed to a light and shadow image and developed by bringing the image bearing surface into developing configuration with an applicator containing developing quantities of liquid developer thereon. The liquid developer is transferred according to the appropriate technique from the developer applicator onto the image bearing surface in image configuration. Thereafter, the developer pattern is transferred from the imaging surface to a receiving surface such as paper. During the transfer step, not all the liquid developer is transferred and therefore a subsequent cleaning step is required.

In an electrophoretic development system, the entire imaging surface is contacted with the liquid developer with the charged particles separating from the carrier liquid and migrating to the charged field or image portions. The particles strongly adhere to the imaging surface by means of van der Waals forces since the particles frequently come within about five hundred angstroms of the imaging surface. The van der Waals forces are so strong that in the subsequent transfer step, a considerable portion of the particles remain on the imaging surface thus, producing prints of relatively low density. In addition to poor density with transfer, the adhering particles on the imaging surface drastically increase the effort necessary to clean the residual developer from the imaging surface and frequently require sufficient cleaning to result in degradation of the photoconductor. In general, electrophoretic development in systems employing recycling electrostatographic imaging surfaces provides low efficiency in both transfer of the developer to a receiving surface and in the cleaning step.

In the polar ink development systems disclosed in U.S. Pat. No. 3,084,043, the developing liquid is relatively conductive having a resistivity less than $10^{10}$ ohm-cm. After transfer of the developer in image configuration from the electrostatographic imaging surface to a receiving surface and even relatively vigorous cleaning, a portion of this type of developer is also observed to remain on the imaging surface. This developer residue is damaging to cyclical use of the imaging surface. Subsequent recharging of a photoconductor, for example, may be inadequate since the conductive liquid may dissipate the charge. Furthermore, lateral conductivity of the liquid developer on the photoconductor may become excessive and the resolution of the resulting image will be poor.

An electrostatographic imaging system and the general class of developer materials useful therein which overcomes the above noted deficiencies is the subject of copending parent application Ser. No. 839,801. This basic technique involves the use of a relatively electrically nonconductive liquid developer which is substantially uniformly distributed in the depressed portions or valleys of a developer dispensing member. Development is obtained by placing the applicator surface sufficiently close to the electrostatographic imaging surface such that the relatively nonconductive liquid developer is pulled from the recessed portions of the applicator surface to the imaging surface in image configuration. Generally, to provide maximum image density, it is preferred to place the raised portions of the applicator surface in slight or gentle contact with the imaging surface provided that the raised portions are substantially free of liquid developer.

This principal novel development technique enables the recycling of reusable imaging surfaces in a type of development system employing a liquid developer. In addition, this basic technique is capable of producing prints of improved resolution and density and reduced background.

The liquid developers presently available, however, are not suited to use in this type of development technique. Those liquid developers capable of use in the development technique disclosed in U.S. Pat. No. 3,084,043 are generally aqueous or water compatible and thus, generally too electrically conductive. Conventional electrophoretic liquid developers generally are relatively unstable in that they are somewhat volatile and therefore, evaporate on standing. The composition of electrophoretic developers may be altered by the settling of the toner particles and there may be a gradual toner depletion since the toner particles separate from the carried liquid during development. In addition, electrophoretic developers are polarity sensitive in that the material must be specially selected to develop charge patterns of either positive or negative charge. To insure this sensitivity to but a single polarity, most electrophoretic developers require the presence of a material or agent to control the polarity of charge. In addition, since conventional electrophoretic developers contact the entire imaging surface during development they should not contain highly penetrating liquids since the toner particles are separated from the liquid and the liquid must be evaporated. Penetration of the liquid would tend to increase background deposits. This electrophoretic separation of charged particles from the carrier liquid results in the deposition of the toner particles on the surface of the receiving sheet rather than within the fibrous matrix and images so produced are poorly fixed and subject to considerable smearing or smudging of the toner pattern. The high volatility required in electrophoretic developers to enable removal from background areas requires some heating means capable of vaporizing the liquid which presents an undesired fire hazard.

Electrophoretic liquid developers require low concentrations of toner particles in order to maintan the viscosity sufficiently low to enable rapid development without considerable background deposition. Such developers when employed in the development technique described in copending application Ser. No. 839,801, produce images of low density.

It is, therefore, clear that there is a continuing need for a better liquid development technique and a better liquid developer.

SUMMARY OF THE INVENTION

It is therefore an object of this invention to provide a development system and developer materials which overcome the above noted deficiencies.

It is another object of this invention to provide a liquid developer which is chemically stable.

It is another object of this invention to provide a liquid developer which is of low volatility.

It is another object of this invention to provide a liquid developer which does not require the use of a charge control agent.

It is another object of this invention to provide a liquid developer which is capable of developing charge patterns of both positive and negative polarity with equal ability.

It is another object of this invention to provide a liquid developer capable of producing images of increased smudge resistance.

It is another object of this invention to provide a liquid developer which is fast drying and fixes by absorption.

It is another object of this invention to provide liquid developers which are not polarity sensitive and which are stable suspensions independent of particle surface potential or concentration.

it is another object of this invention to provide liquid developers having high pigment contents.

It is another object of this invention to provide a liquid development system producing prints of improved resolution and density.

It is another object of this invention to provide an electrostatographic imaging system employing a nonvolatile liquid developer which produces dry prints without subjecting the print to vaporization of liquid in the background areas.

It is another object of this invention to provide an electrostatographic imaging system of the liquid development type which produces dry prints with reduced background deposits.

It is another object of this invention to provide liquid development systems and liquid developers superior to known systems and materials.

The above objects and others are accomplished, generally speaking, by providing an electrostatograhic imaging system wherein an electrostatic latent image is developed with a relatively nonconductive, nonaqueous, chemically stable, ambipolar liquid developer of low volatility which is substantially uniformly distributed in the depressed portions or "valleys" of a developer dispensing member which member is positioned adjacent the image bearing surface during development.

More specifically, an electrostatic charge pattern present on an imaging surface is developed according to the technique described in copending parent application Ser. No. 839,801 with a chemically stable, absorptive drying liquid developer comprising an oleaginous liquid vehicle, solid colorant particles, a dispersant which is soluble in the liquid developer and which is capable of substantially completely supressing background depositions, and a fixing agent miscible with the vehicle and which is capable of penetrating copy paper to enable the liquid developer to dry by absorption.

The presence of the above recited four constituents each in specified quantities when employed as a liquid developer in electrostatographic imaging techniques provides developed images on ordinary paper which are highly resistant to smuding and smearing, which have superior image density and a marked absence of background deposits. In addition, these liquid developers are capable of developing charge patterns of both positive and negative polarity with substantially equal ability. These liquid developers provide dry images which are rapidly fixed on ordinary paper in the absence of vaporization of excess liquid or chemical reaction. In addition to the recited four constituents, the presence of an additional material to act as a suspending agent for the solid colorant particles is particularly advantageous in providing maximum uniformity of suspension of the pigment particles in the vehicle while maintaining the desired viscosity and in maintaining the liquid developer substantially free of agglomerates.

The liquid developers according to this invention are ambipolar. That is, when the liquid developer is placed adjacent to an imaging surface bearing an electrostatic charge pattern, a charge of opposite polarity is induced in the liquid developer and this inducement of charge in the liquid developer may be accomplished in any particular developer with respect to either a positive or a negative charge on the imaging surface. In other words, unlike classical electrophoretic developers, the ambipolar developers are equally effective in developing positive as well as negative charge patterns on imaging surfaces, the difference being only in the polarity of charge which is induced in the developer. Further, unlike electrophoretic developers, migration of the charged particles from the insulating carrier liquid plays no significant roll. Instead, charge is induced in the entire developer which migrates substantially intact, both liquid portion and colorant particles, from the developer applicator to the imaging surface. To insure this ambipolar quality, the individual constituents of the liquid developer must possess compatible electrical properties.

Typically, the liquid developers have bulk resistivities greater than about $10^8$ ohm-cm and less than about $10^{15}$ ohm-cm. In recycling systems, the more electrically conductive the developer, the greater the opportunity for decreased charge retention and increased lateral conductivity on the imaging surface and therefore poor resolution. In these systems, experience has indicated that the bulk resistivity should generally be greater than about $10^{10}$ ohm-cm. As described in application Ser. No. 839,801, the more electrically resistive the developer, the greater the time constant for lateral discharge of the image. This lateral discharge is of significance in the recycling system since for each cycle a small residue of the developer may remain on the imaging surface from the preceding cycle and an additional charge is placed on the imaging surface with this residual developer still on it. Since practical electrostatic imaging rates require a latent image life of at least about 1 second and preferably 2 to 5 seconds, liquid developers possessing adequate time constants for lateral discharge, generally have resistivities of at least about $10^{10}$ ohm-cm. In addition, since the rate of development involves the rate of charge induction through the liquid developer which is dependent upon the resistivity of the vehicle and practical development speeds are generally greater than about 3 inches per second, the resistivity of a practical operating range providing balance between conductivity, time constant in development speed is from about $10^{10}$ to about $10^{14}$ ohm-cm.

Contrary to the relatively high volatility of the electrophoretic liquid developers, the liquid developer according to this invention in general, have very low evaporation rates which permits increased shelf life and performance life in an automatic machine while maintaining the concentration of all constitutents substantially the same throughout their entire life span. Typically, the liquid developers of this invention have evaporation rates such that after about 28 days exposure at a temperature of 60° C. there is a weight loss of less than about 0.0050 grams per square centimeter of surface area exposed. In minimizing fluctuation in concentrations of materials and in extending useful life of the developer, it is preferred that this weight loss be less than about 0.004 grams per square centimeter.

The liquid developers according to this invention are nonaqueous. That it, they are not water or water compatible materials since such materials generally have relatively high evaporation rates and are relatively conductive. The liquid developer has low shear viscosity ranges of up to about 3000 centipoises measured at 25° C. Such viscosities are practical for development systems employing development speeds generally of the order of from about 5 to about 20 inches per second. Increased development speeds of the order of 200 inches per second requires a lower viscosity, typically of the order of about 100 centipoises. The viscosity is in part dependent on the colorant loading of the vehicle and as the concentraion of colorant is increased, the viscosity of the liquid developer increases and the operable development speed is accordingly lowered. Control of the balance between colorant loading and concentration of other constitutents to obtain the desired image density and development speed may be readily determined by one skilled in the art within the proportional limits hereinafter set forth.

The liquid developers of the present invention are fixed by absorption. That is, the developer is absorbed by the copy paper after transfer or during imaging. Image fixing does not rely on evaporation, oxidation or precipitation of any component of the liquid developer.

Typically, the liquid developers of this invention require only about 1 to 2 seconds to dry with the solid colorant and the developer liquid penetrating into the paper and substantially no colorant particles being held in relief on the top surface of the paper. Thus, the liquid developers of this invention provide a substantily instantaneous dry copy on ordinary paper and since the colorant particles are held within the matrix of the paper, provide excellent resistance to smudging.

Any suitable oleaginous vehicle contributing to the above properties may be employed. By oleaginous vehicles, it is intended to include oils, oil like vehicles or vehicles resembling the properties of oils. Typically, the oleaginous vehicles have bulk resistivities of from about $10^8$ ohm-cm to about $10^{15}$ ohm-cm. Typical materials within this group which may be employed alone or in combination include among others mineral oil, the vegetable oils such as castor oil and its oxidized derivatives, peanut oil, coconut oil, sunflower seed oil, corn oil, rapeseed oil and sesame oil. In addition, fluorocarbon oil such as DuPont's Freon solvents, Krytox oils, silicon oils, kerosene, oleic acid and mineral spirits may be employed. Mineral oils are especially preferred as vehicles for liquid developers because they are readily available in numerous viscosity grades and are colorless, odorless, nontoxic and of low volatility.

Any suitable solid colorant material may be employed in the liquid developer. To obtain permanence, it is preferred that the colorant be fast to light. The solid colorant may be of any suitable size. Typically, the colored marking particles are from about 0.01 to about 10 microns in size. For superior image resolution, it is preferred that the colored marking particles be from about 0.1 microns to about 1 micron. Typical solid colorants include solid finely divided colored materials such as pigments, xerographic toners and other marking particles. Typical pigments include carbon black, charcoal and other forms of finely divided carbon, quinacridons, phthalocyanine blues, iron oxide, ultramarine blues, zinc oxide, titanium dioxide and benzidine yellow. Typical xerographic toners include finely divided thermoplastic resins or blends of thermoplastic resins in which pigments such as carbon black are dispersed.

The dispersants are incorporated to provide substantially uniform wetting of the colorant in the oleaginous liquid and dispersion of the colorant material in the liquid developer. The dispersants further function to reduce colorant agglomerates and sedimentation and serve to maintain the colorant material in stable suspension without flocculation. A principal function of the dispersant is to suppress the deposition of deposits in the background and nonimage areas of the imaging surface. The dispersant is miscible with the liquid developer in order to provide an integral developer wherein during development, there is no phase separation. The precise mechanism by which the disperant inhibits the deposition of background deposits is not fully understood. It is clear, howver, that in the absence of the presence of a dispersant, considerable background is present. Any suitable dispersant may be employed that is miscible with the developer vehicle. Typical dispersants providing the dual function of dispersing the solid colorant particles and suppressing background include alkylated polyvinyl pyrroidones and copolymers of alkyl vinyl ethers and maleic anhydride which are miscible with the oleaginous vehicle of the liquid developer. Typical alkylated polyvinyl pyrrolidones include those wherein there is at least about one alkyl substitution for each monomer unit the substitution generally being in the pyrrolidone moiety and wherein the alkyl substitutent has a carbon chain length of from about 10 to about 20 carbon atoms. Also included are polymers containing both nonalkylated and alkylated polyvinyl pyrrolidones, which may, for example, be prepared by copolymerizing mixtures of the alkylated and nonalkylated monomeric vinyl pyrrolidones. In these polymers the nonalkylated vinyl pyrrolidone units may be present in amounts up to about 80% of the total number of vinyl pyrrolidone units. Generally, these alkylated polyvinyl pyrrolidones have molecular weights of from about 5,000 to about 300,000. Typical specific materials include decalated polyvinyl pyrrolidone, dodecalated polyvinyl pyrrolidone, tridecalated polyvinyl pyrrolidone, tetradecalated polyvinyl pyrrolidone, pentadecalated polyvinyl pyrrolidone, hexadecalated polyvinyl pyrrolidone and octodecylated polyvinyl pyrrolidone.

Typical copolymers of alkyl substituted vinyl ethers and maleic anhydride include those wherein the alkyl substitution of the vinyl ether has a carbon chain of from about 14 to 20 carbon atoms. Typical linear polymers may be manufactured by copolymerizing the alkyl vinyl ethers and the maleic anhydride in from about one to one to about a three to one mole ratio of ether to anhydride respectively. A wide range of molecular weights for these copolymers may be employed. Generally, the most suitable materials have molecular weights of from about 5,000 to about 15,000. In addition, it is to be understood that derivatives such as esters and amides of these polymers may be employed particularly where increased surface activity is desired. Specific suitable materials with which the maleic anhydride may be copolymerized include tetradecyl vinyl ether, hexadecyl vinyl ether, and octadecyl vinyl ether. In each of these two classes of materials, the length of the alkyl chain is controlled to provide the necessary miscibility and solubility in the oleaginous vehicle of the liquid developer.

The liquid developer may contain any suitable fixing agent. Typically, the fixing agent provides in addition to accelerating the penetration of the liquid developer in the copy paper and the absorption of the developer by the copy paper, a reduction in viscosity of the liquid developer which may have been increased by the presence of colorant particles. In this regard, the fixing agent may in part, provide a secondary or auxiliary vehicle for the liquid developer. The fixing agents employed in the practice of this invention are alkyl and alkylene esters of saturated and unsaturated mono and poly basic carboxylic acids. Any suitable ester of this class may be employed. Typically, the ester has a long chain acid portion which is soluble in the vehicle while the alcohol moiety seeks to wet and penetrate the paper. Typically, the fixing agents are prepared from the esterification of mono and polybasic carboxylic acids having from about 6 to about 20 carbon atoms. Typical monocarboxylic acids include phthalic, caprylic, pelargonic, capric, stearic, palmitic and oleic acid. Typical dicarboxylic acids include adipic acid and sebacic acid. Typical tricarboxylic acids include trimellitic acid, trimesic acid, hemimellitic acid. The fixing agents employed in the practice in this invention are typically prepared from mono and polyhydric alcohols derived from saturated and unsaturated aliphatic hydrocarbons having from about 2 to about 20 carbon atoms. Typical materials include ethyl alcohol, propyl alcohol, butyl alcohol, amyl alcohol, hexyl alcohol, octyl alcohol, decyl alcohol, and tridecyl alcohol. Typical alkylene glycols include ethylene glycol, diethylene glycol, triethylene glycol, propylene glycol and dipropylene glycol. Typical specific esters include dibutyl phthalate, butyl isodecyl phthalate, butyl octyl phthalate, butyl benzyl phthalate, diisooctyl phthalate, di(2-ethyl hexyl) phthalate, isooctyl isodecyl phthalate, normal octyl decyl phthalate, diisodecyl phthalate, ditridecyl phthalate isodecyl tridecyl phthalate, diisooctyl adipate, di(2-ethyl hexyl) adipate, isooctyl isodecyl adipate, normal octyl decyl adipate, diisodecyl adipate, diisooctyl sebacate, di 2-ethyl hexyl sebacate, isooctyl palmitate, butyl stearate, butyl oleate, triethylene glycol dicaprylate, triethylene glycol caprylate-caprate, triethylene glycol diperlargonates diethylene glycol dipelargonate, butanedial dicaprylate, triisooctyl trimellitate, tri 2-ethyl hexyl trimellitate, and mixed normal trialkyl trimellitates.

The proportions of the several constituents of the developer may be varied over a wide range depending upon the individual properties of each of the constituents and the operational considerations required by the specific development system. A significant fact in determining these proportions is the speed of development, since with higher speeds, lower viscosity developers must be used than at lower speeds. From the enumerated ranges given below, one skilled in the art may readily determine the appropriate proportions for any given development speed.

The several constituents may generally be present in a liquid developer in amounts according to the following weight percentages:

Oleaginous vehicle—from about 30 to about 85 wt.%
Colorant—from about 5 to about 60 wt. %
Dispersant—from about 1 to about 35 wt.%
Fixing agent—from about 5 to about 45 wt.%

Within this broad range of proportions, particularly improved results with regard to reduced background deposits and increased smudge and smear resistance are provided with a liquid developer having the following compositions by weight:

Oleaginous vehicle—from about 35 to about 75 wt.%
Colorant—from about 10 to about 35 wt.%
Dispersant—from about 2 to about 25 wt.%
Fixing agent—from about 10 to about 35 wt.%

The formulations providing optimum image density in resolution while maintaining background deposits at a very low level are obtained with colorant loadings of between about 15% to about 30% by weight.

Developers of this invention may be prepared by any suitable technique. The liquid developers may, for example, be prepared simply by mixing the several constituents together. To provide homogenity, however, it is generally preferred to premix the liquid constituents of the developer while heating and then add the solid constituents which may include the dispersant and solid colorant. Alternatively, the solid colorant may be comminuted separately or together with the vehicle.

Exceptional dispersion of the pigment particles in the liquid developer accompanied by substantially no background deposition is obtained when the colorant particles have been previously dispersed in a resin matrix. This predispersion of the colorant particles enables the liquid developer to be rapidly formed and facilitates the maintenance of the substantially uniform dispersion of the colorant particles in the liquid vehicle without the formation of agglomerates. The colorant particles may be predispersed in any suitable resinous material. Generally, the resin matrix in which the colorant particles are predispersed remains coated on the colorant particles throughout the useful life of the liquid developer. Typical resinous materials include phenolic resins such as Amberol ST-137X available from Rohm & Haas Company and terpene phenolic resin such as LTP-100 available from Pennsylvania Industrial Chemical Corporation, polychlorinated polyphenyl resins such as Aroclor 5460 available from Monsanto Company, betapinene polymers, such as Gammaprene A-115 or A-125, available from Reichhold Chemicals, Incorporated, coumarone-indene resins such as Piccovar-75 and Piccoumaron 450-L, styrene copolymers such as Piccolastic-75, all available from Pennsylvania Industrial Chemical Corporation and Gilsonite hydrocarbon resins available from American Gilsonite Company. Particularly effective dispersion of the colorant particles is obtained when they are dispersed in an ester gum such as those produced from the esterification of natural resins with polyhydric alcohols. Typical of this group of ester gums are the glycerol an pentaerythritol esters of resin. These resins are made by the esterification of three separate acid molecules in the rosin in which approximately 87% of the acid mixture is dihydroabietic acid which in turn is comprised of approximately 50% of the hydrogenated derivative of abietic acid. The remainder of the acid constituents includes a small percentage of abietic acid. Typically, these ester gums include the glycerol ester of dihydroabietic acid, the glycerol triester of abietic acid, the triethylene glycol diester of dihydroabietic acid, the diethylene glycol diester of dihydroabietic acid, the diethylene glycol diester of abietic acid, the ethylene glycol ester of dihydroabietic acid, and the ethylene glycol ester of abietic acid. The predispersed colorant particles may be made in any suitable manner. Typically, the colorant particle and resin are mixed together while suspended in a liquid and the mixture is dried to provide solid colorant particles with a resinous coating. The predispersed colorant particles may be employed in a liquid developer in any suitable amount. Typically, the predispersed colorant particles contain from about 20 wt.% to about 50 wt.% of the colorant particle and from about 50 wt.% to about 80 wt.% resin matrix all by weight of the predispersed colorant particle. Superior dispersion of the colorant particles in the liquid developer over an extended period of time is obtained when the proportion of resin matrixes is from about 55 wt.% to about 70 wt.% by weight of the predispersed colorant particle and the amount of the predispersed colorant present in the liquid developer is from about 25% to about 50% by weight of the liquid developer.

The liquid developer of the instant invention may be employed to develop an electrostatic latent image present on any suitable electrostatographic imaging surface. Basically, any surface upon which an electrostatic charge pattern may be formed or developed may be employed. Typical electrostatic imaging surfaces include dielectrics such as plastic coated papers, xeroprinting masters, and photoconductors. Typical photoconductors that may be employed include selenium and selenium alloys, cadmium sulfide, cadmium sulfo selenide, phthalocyanine binder coatings and polyvinyl carbazole sensitized with 2,4,7-trinitrofluorenone. The electrostatographic imaging surface may be employed in any suitable structure including plates, belts or drums and may be employed in the form of a binder layer coated on a substrate. The imaging surfaces may be overcoated with suitable dielectric materials in conventional manner. Development of electrostatic latent image may be obtained by positioning an applicator surface with liquid developer thereon adjacent to the electrostatographic imaging surface. Any suitable applicator surface may be employed which has a substantially uniform pattern of raised portions and depressed portion provided that the depressed portions are sufficiently large to hold developing quantities of liquid developer therein. To minimize wear on the imaging surface, it is preferred to provide raised portions which are uniformly curved or substantially flat on the surfaces which contact the imaging surface.

Typical applicator surfaces include, among others, porous ceramics, metallic sponge, patterned webs or belts, capillary combs, and cylindrical rolls having surface patterns such as single screw cuts or trihelicoid, pyramidal or quadragravure indentations.

The applicator surface may be loaded with developer in any suitable manner. Typical developer loading techniques include applying developer from a roll or sponge roll or immersing the applicator in a bath. Prior to contacting the imaging surface, the applicator surface should be wiped or "doctored" clean to remove substantially all liquid developer from the raised portions of the applicator surface. Any suitable means may be provided as the doctoring device. Typical doctoring devices include scraper blades and squeegee rolls. The doctoring in addition to removing liquid developer from the raised portions of the applicator surface preferably provides a slight wiping action of the liquid developer in the recessed portions of the applicator surface to thereby maintain the level of the liquid developer in the recessed portions slightly below the level of the raised portions. Such a loading of developer on the applicator surface minimizes deposits in the nonimage areas.

In the cycling electrostatographic imaging systems of the present invention, it is generally necessary to cyclically clean the imaging surface. Any suitable cleaing system may be employed. A typical cleaning system scrubs the ink film on the photoconductor surface obliterating the image pattern by smearing the developer over the surface. The residual developer is subsequently picked up by an absorbent web which may absorb the developer. For example, a squeegee roller may be used as the scrubbing or obliterating device and an absorbent web wrapped around a portion of the photoconductor drum and moving slowly counter to the direction of rotation of the drum may be used.

The mechanism of development according to this invention is presently believed to be substantially the same as that in the polar liquid development technique described by R. W. Gundlach in U.S. Pat. No. 3,084,043. The liquid developer is applied to the patterned applicator such that the raised portions of the applicator surface are substantially free of developer and the level of liquid in the recessed portions of the applicator is slightly below the level of the lands. Surface tension retains the developer in cohesive configuration in the depressed portion of the applicator surface and as the raised portions of the applicator surface are placed in light or gentle contact with the electrostatographic imaging surface, the liquid developer in resonse to the electrostatic field of force on the imaging surface creeps up the sides of the depressed portions of the applicator surface and deposits on the imaging surface substantially only in accordance with the pattern of electric charge. The developer remains in the depressed portions of the applicator surface except in those portions which are under the influence of the attracting electrostatic force.

The developer applicator is generally biased or directly connected to ground through connection to a variable D.C. potential source so that the liquid developer will be electrostatically attracted from the applicator to the imaging surface in image configuration. When so biased, the charges on the imaging surface induce equal and opposite charges in the liquid developer. For example, when the applicator is grounded and the image surface carries a positive charge, negative charge is induced in the liquid developer adjacent the positive charges and the developer moves toward the imaging surface in response to the electrostatic field generated between these charges. Portions of the imaging surface carrying no charge, induce no charge in the developer and thus, the developer is not pulled out of the recessed portions of the applicator surface to nonfield areas of the image surface.

Reversal development may be obtained by applying to the developer applicator a potential of the same polarity and of the same amount as the charged areas on the imaging surface to cancel out the field at charged areas and provide an electrostatic field between the uncharged areas of the imaging surface and the developer on the applicator surface. Again, a charge is induced in the developer in response to the electrostatic field and the developer creeps up the recessed portions of the applicator surface adjacent areas of the imaging surface which are uncharged.

As discussed above, unlike classical electrophoretic developers, liquid developers of this invention are capable of developing positively as well as negatively charged patterns by having induced in the liquid developer in response to the charge pattern a polarity of charge opposite that of the charge pattern. In addition, unlike electrophoretic development, migration of charge particles from the carrier liquid plays no significant role. While this particle migration may not be totally inhibited, if present, it is present to an extent which is insignificant as far as formation of visible images is concerned. This mechanism is generally substantiated by the fact that in development, according to the disclosed technique, the liquid developer is readily transferred and cleaned from the imaging surface and there is no evidence of the deposition of pigment particles out of the developer on the imaging surface. The additional observation that the developed image obtained according to the instant technique comprises both pigment particles and carrier liquid in substantially the same relative proportions as present in the original developer supply whereas the developed image obtained through electrophoretic development comprises substantially only the solid particles which have separated from the carrier liquid is further evidence of the differences between conventional liquid developers and the described liquid developer.

DESCRIPTION OF PREFERRED EMBODIMENTS

The following preferred nonlimiting examples further define, describe and compare preferred materials and techniques of the present invention. Examples II and III are included for comparitive purposes to show the surprisingly superior and unexpected results obtained in the practice of this invention. In the examples, all parts and percentages are by weight unless otherwise specified.

EXAMPLE I

A commercially available paperbacked zinc oxide binder layer photoconductor is charged and exposed in conventional manner. The electrostatic latent image is developed with a developer having the following composition by weight:

Mineral Oil (Drakeol 9)—35 parts by weight
Carbon Black (Elftex 8)—20 parts by weight
Alkylated Polyvinyl Pyrrolidone (Ganex V216)—12 parts by weight
Triethylene Glycol Dicaprylate (Rucoflex TG-8)—33 parts by weight Drakeol 9 is a mineral oil manufactured by Pennsylvania Oil and Refining Company having a kinematic viscosity of about 17 centistokes at 25° C. and a specific gravity of about 0.84. Elftex 8 is a fine particle size carbon black available from Cabot Corporation. Rucoflex TG-8 is triethylene glycol dicaprylate available from Hooker Chemical Company. Ganex V216 is an alkylated polyvinyl pyrrolidone compound with about 20% of the monomeric vinyl pyrrolidone units nonalkylated and 80% alkylated with an alkyl group of about 16 carbon atoms and an average molecular weight of about 7,300 manufactured by GAF. The developer is prepared by combining the mineral oil triethylene glycol dicaprylate and the alkylated polyvinyl pyrrolidone in a suitable vessel while stirring, and then adding the carbon black and ball milling the mixture in a ball mill for about 48 hours. This liquid developer has an electrical resistivity of about $10^{10}$ ohm-cm and is applied to a cylindrical applicator roll having a trihelicoid pattern on the surface such that the liquid developer fills the grooves to a level slightly below the level of the ridges and is doctored to provide substantially dry ridges. The image on the zinc oxide binder layer is developed by moving this applicator roller loaded with the liquid developer over the binder layer at a speed of about 10 inches per second such that the edges of the roller are just in contact with the surface of the binder layer. The developer on the zinc oxide binder layer in image configuration is transferred to Xerox 4024 bond paper where after about 2 seconds, a dry print with a resolution of about 8 line pairs per millimeter is observed. In addition, the print has excellent image density of about 0.93 and substantially no background, the background density being less than about 0.01 and is highly resistant to smudging when a pencil eraser is firmly pulled across the image.

EXAMPLE II

The procedure of Example I is repeated except that the liquid developer employed does not contain the alkylated polyvinyl pyrrolidone. Imaging and development are accomplished in the same manner as described in Example I. The paper is relatively dry after about 4 seconds and the print obtained on the bond copy paper has a resolution of about 6 line pairs per millimeter. Fair image density of about 0.75 and high background density of about 0.2 makes this developer unsuitable.

EXAMPLE III

The procedure of Example I is repeated except that the triethylene glycol dicaprylate is omitted from the liquid developer. Imaging and development are obtained in the same manner as Example I. Transfer of the liquid developer to Xerox 4024 bond paper in image configuration produces a final print which after about 30 seconds is still wet and oily. After 45 seconds, a final print of substantially the same quality as that obtained in Example I is obtained. The extended period during which the print is moist is highly undesirable from an automatic machine standpoint.

EXAMPLE IV

The liquid developer employed in this example is of the following composition by weight and has a bulk resistivity of about $10^{10}$ ohm-cm and a dielectric constant of about 3.36.

Mineral Oil (Drakeol 9)—75 parts by weight
Carbon Black (Statex B-12)—15 parts by weight
Copolymer of Octadecyl Vinyl Ether and Maleic Anhydride (Gantrez AN-8194)—5 parts by weight
Isoctyl Isodecyl Phthalate—5 parts by weight Statex B-12 is a carbon black available from Columbia Carbon Company. Gantrez AN-8194 is a linear polymer formed from equal molar quantities of octadecyl vinyl ether and maleic anhydride and having a molecular weight of about 10,000 available from GAF Corporation. The developer is prepared by combining the mineral oil and the dispersant in a vessel while stirring and heating. Subsequently, the pigment and the ester are added while continuing the stirring. The mixture is cooled and then ball milled as in Example I. An electrostatic latent image is formed on a clean selenium xerographic plate comprising a surface layer of selenium about 50 microns in thickness on a conductive aluminum plate. The selenium plate is charged and exposed in conventional manner and the image is developed by moving the applicator roller bearing liquid developer in the manner described in Example I over the selenium plate at a speed of about 10 inches per second such that the edges are just in contact with the surface of the plate. The developer is transferred from the selenium plate to bond paper in image configuration. A dry image on the bond paper having a resolution of about 10 line pairs per millimeter, an image density of about 0.95 and substantially no background is obtained. The selenium plate is manually cleaned with a cotton cloth to remove substantially all the liquid developer. The selenium plate is again charged, exposed, developed, the image transferred and cleaned as above for a plurality of cycles. Satisfactory prints are obtained for 5 cycles.

EXAMPLE V

The procedure of Example IV is repeated with a liquid developer of the following composition by weight, a bulk resistivity of about $10^{11}$ ohm-cm and a dielectric constant of about 3.44.

Oleic acid—40 parts by weight
Benzidine Yellow OT—15 parts by weight
Tetradecylated Polyvinyl Pyrrolidone—5 parts by weight
Butyl Benzl Phthalate—B 'parts by weight Benzidene Yellow OT is a pigment available from E. I. duPont deNemours and Company. Results substantially the same as those described in Example IV are observed.

EXAMPLE VI

The procedure of Example IV is repeated with a liquid developer having the following composition by weight, a bulk resistivity of about $10^{10}$ ohm-cm and a dielectric constant of about 3.0.

Peanut Oil—30 parts by weight
Hostaperm Pink E—20 parts by weight
Alkylated polyvinyl pyrrolidone (Ganex V-220)—25 parts by weight
Tri-n-hexyl trimeltitate—25 parts by weight Hostaperm Pink E is a quinacridone pigment available from American Hoechst Corporation. Ganex V-220 is an alkylated polyvinyl pyrrolidone available from GAF Corporation with about 20% of the monomeric vinyl pyrrolidone units nonalkylated and 80% alkylated with an alkyl chain of about 20 carbon atoms. The resolution and background of the print obtained on bond paper is substantially the same as that obtained in Example IV. Image density and contrast, however, are slightly superior to that in Example IV.

EXAMPLE VII

The procedure of Example IV is repeated except that the liquid developer employed in this example is of the following composition by weight and has a bulk resistivity of about $10^{12}$ ohm-cm.

Castor oil—55 parts by weight
Phthalocyanine (Monolite Fast Blue GS)—30 parts by weight
Alkylated polyvinyl pyrrolidone (Ganex V-516)—5 parts by weight
Butyl Stearate—10 parts by weight Monolite Fast Blue GS is a phthalocyanine pigment available from Imperial Chemicals, Ltd. Ganex V-516 is an alkylated polyvinyl pyrrolidone with about 50% of the monomeric vinyl pyrrolidone units nonalkylated and 50% alkylated with an alkyl chain of about 16 carbon atoms and available from GAF. Upon transfer of the developer from the selenium plate to bond paper, print quality is observed to be substantially the same as that in Example VI.

EXAMPLE VIII

The procedure of Example IV is repeated with the developer having the following composition by weight and a bulk resistivity of about $10^{11}$ ohm-cm and a dielectric constant of about 3.2.

Mineral Oil (Drakeol 9)—38 parts by weight
Predispersed Pigment (Microlith CT Black)—38 parts by weight
Alkylated Polyvinyl Pyrrolidone (Ganex V216)—15 parts by weight
Triethylene glycol dicaprylate (Rucoflex TG-8)—9 parts by weight Microlith CT Black is a resinated predispersed carbon black pigment composed of about 33% by weight carbon black pigment and 66% by weight ester gum resin available from CIBA. The mineral oil, alkylated polyvinyl pyrrolidone and triethylene glycol dicaprylate were mixed together in a suitable vessel and stirred to disperse the several constituents. The mixture is thereafter added to the tank of a Kady mill to which the predispersed carbon black is charged sequentially in small amounts over a period of 10 minutes. The developer is milled in the Kady mill for about 10 minutes. Imaging and development are obtained in the same manner as that described in Example IV. The final copy on bond paper is dry, substantially free of background deposits, and has a resolution of about 10 line pairs per millimeter. Immediately after transfer of the developer from the selenium plate to the bond paper, the image is not smeared when a finger is lightly drawn across it.

EXAMPLE IX

The procedure of Example VIII is repeated with a liquid developer prepared according to the technique of Example VII and having the following composition by weight, a bulk resistivity of about 10 ohm-cm and a dielectric constant of about 3.3.

Mineral Oil—40 parts by weight
Predispersed pigment (Microlith Green GT)—25 parts by weight
Copolymer of octadecyl vinyl ether and maleic anhydride (Gantrez AN-8194)—5 parts by weight
Butyl stearate—30 parts by weight Microlith Green GT is a predispersed chlorinated phthalocyanine pigment similar to Microlith CT Black available from CIBA. Prints of substantially the same quality described in Example VIII are obtained.

EXAMPLE X

A xeroprinting master is prepared by placing a thin insulating coating of epoxy resin about 0.0005 inches thick in image configuration on a conductive aluminum plate. The plate is positively charged to 450 volts by passing it under a corona charging unit. The image is developed in the manner described in Example I with a liquid developer having the following composition and a bulk resistivity of about $10^{10}$ ohm-cm.

Oleic acid—40 parts by weight
Carbon Black (Statex)—10 parts by weight
Copolymer of tetradecyl vinyl ether and maleic anhydride—15 parts by weight
n-octyl decyl adipate—35 parts by weight The dispersant is formed from about equal molar quantities of tetradecyl vinyl ether and maleic anhydride. The developer is transferred to bond paper and the resulting print has image density of about 0.8, background density of about 0.02 and a resolution of about 7 line pairs per millimeter. Substantially no background deposits are observed.

EXAMPLE XI

The procedure of Example I is repeated with a liquid developer prepared in the manner described in Example VIII having the following composition by weight and a resistivity of about $10^{11}$ ohm-cm.

Oil (Cottonseed Oil)—45 parts by weight
Predispersed pigment (Microlith Bordeaux RT)—20 parts by weight
Copolymer of nonadecyl vinyl ether and maleic anhydride—10 parts by weight
Diisooctyl sebacate—25 parts by weight Microlith Bordeaux RT is a predispersed pigment similar to Microlith Black CT available from CIBA. The dispersant is formed from about equal molar quantities of nonadecyl vinyl ether and maleic anhydride. Prints of substantially the same quality described in Example VIII are obtained.

Examples I and IV through XI demonstrate the superior imaging characteristics obtainable with the use of the liquid developers of this invention. These developers provide a final copy or print which is substantially completely free of background deposits which is highly resistant to smearing and smudging and which is dry rather than oily. In addition, the image density and contrast are vastly superior to that obtained with prior liquid developers. Comparison with Examples II and III readily demonstrates the superiority with regard to background deposition drying and smudge resistance. In Example II, the same developer as in Example I is employed but without the presence of one of the selected dispersants. This developer provides a final copy which has considerable deposition in the background areas. Example III provides final copy of quality similar to that in Example I after a period of a time during which the liquid developer penetrates the copy sheet. However, immediately following transfer to the copy paper, the receiving sheet is wet and highly smudgable. Examples VIII, IX and XI demonstrate the added advantage to preparation with a predispersed pigment since ball milling of the mixture is not required.

The liquid developers of the present invention have several additional advantages over known liquid developers. They may, for example, be employed in imaging systems which use both reusable imaging surfaces and single use imaging surfaces. In addition, they may be employed with imaging techniques that do not require a drying or heat fixing step since they provide dry, nongreasy copy prints without a separate fusing or fixing step. In addition, as discussed above, the liquid developers of this invention provide nongreasy background free copies substantially immediately after development or transfer. Since there is substantially no particle migration, the composition of the developer in the developer supply does not have to be frequently monitored and adjusted. Further, since the developer penetrates the copy paper, the final image on the copy print is much more resistant to smearing and smudging.

Although specific materials and operational techniques are set forth in the above exemplary embodiments using the developer composition and techniques of this invention, these are merely intended as illustrations of the present invention. There are other developer materials and techniques such as those listed above which may be substituted for those in the examples with similar results. Other modifications of the present invention will occur to those skilled in the art upon a reading of the present disclosure which modifications are intended to be included within the scope of this invention.

What is claimed is:

1. A chemically stable, nonaqueous, ambipolar, absorptive drying electrostatographic liquid developer of low volatility having a resistivity of from about $10^8$ to $10^{15}$ ohm cm comprising from about 30 weight percent to about 85 weight percent of an oleaginous liquid vehicle from about 5 weight percent to about 60 weight percent of a particulate colorant which is insoluble in at least one liquid present in the liquid developer; from about 1 weight percent to about 35 weight percent of a dispersant which is soluble in the oleaginous vehicle and which is capable of substantially supressing background deposits, said dispersant comprising copolymers of alkyl vinyl ethers and maleic anhydride where alkyl substituent of the vinyl ether has a carbon chain length of from 14 to 20 carbon atoms, and from about 5 weight percent to about 45 weight percent of a fixing agent comprising the ester of an acid selected from the group consisting of mono and polybasic carboxylic acids wherein said acids have from 6 to 20 carbon atoms and an alcohol selected from the group consisting of saturated and unsaturated mono and polyhydric aliphatic alcohols having from 2 to 20 carbon atoms.

2. The liquid developer of claim 1 wherein said colorant comprises a pigment which has previously been predispersed in the resin matrix.

3. The liquid developer of claim 2 wherein said resin matrix comprises an ester gum.

4. The liquid developer according to claim 1 wherein said developer has a volatility less than about 0.0050 grams per square centimeter at 60° C. after about 28 days exposure.

5. The liquid developer according to claim 1 wherein said developer has a viscosity of from about 100 to about 3000 centipoises at 25° C.

6. The liquid developer according to claim 1 wherein said particulate colorant has a particle size of from about 0.01 to about 10 microns.

7. The liquid developer according to claim 1 wherein said bulk resistivity is from about $10^{10}$ to about $10^{14}$ ohm cm.

8. The liquid developer according to claim 1 wherein said oleaginous liquid vehicle comprised mineral oil.

9. The liquid developer according to claim 1 wherein said fixing agent comprises triethylene glycol dicaprylate.

10. The liquid developer according to claim 1 wherein said dispersant comprises a copolymer of octadecyl vinyl ether and maleic anhydride.

11. The liquid developer according to claim 1 wherein said oleaginous vehicle is present in an amount of from about 35 to about 75 weight percent, said colorant is present in an amount of from about 10 to about 35 weight percent, said dispersant is present in an amount of from about 2 to about 25 weight percent, and said fixing agent is present in an amount of from about 110 to about 35 weight percent.

* * * * *